US009349548B2

(12) United States Patent
Juricev

(10) Patent No.: US 9,349,548 B2
(45) Date of Patent: May 24, 2016

(54) REDUNDANT EXCESS VOLTAGE CIRCUIT BREAKER WITH A ROTATIONAL DISK AND WITH AN ADDED ELECTRONIC ASSEMBLY INTENDED TO EXTEND A LIFE SPAN OF AN EXCESS-VOLTAGE COMPONENT

(75) Inventor: Igor Juricev, Izola (SI)

(73) Assignee: Iskra Zascite D.O.O., Ljubljana (SI)

( * ) Notice: Subject to any disclaimer, the term of this patent is extended or adjusted under 35 U.S.C. 154(b) by 198 days.

(21) Appl. No.: 14/117,109

(22) PCT Filed: May 11, 2012

(86) PCT No.: PCT/SI2012/000030

§ 371 (c)(1),
(2), (4) Date: Jul. 16, 2014

(87) PCT Pub. No.: WO2012/154134

PCT Pub. Date: Nov. 15, 2012

(65) Prior Publication Data

US 2014/0327990 A1 Nov. 6, 2014

(30) Foreign Application Priority Data

May 11, 2011 (SI) ..... 201100162

(51) Int. Cl.

| | |
|---|---|
| ***H01H 9/54*** | (2006.01) |
| ***H01H 37/76*** | (2006.01) |
| ***H01H 9/30*** | (2006.01) |
| ***H01H 9/32*** | (2006.01) |
| ***H01C 7/12*** | (2006.01) |

(52) U.S. Cl.

CPC ..... *H01H 9/54* (2013.01); *H01C 7/126* (2013.01); *H01H 9/302* (2013.01); *H01H 37/761* (2013.01); *H01H 9/32* (2013.01); *H01H 2037/763* (2013.01)

(58) Field of Classification Search

CPC ..... H01H 37/76; H01H 9/34; H01H 9/302; H01H 9/54; H01C 7/12; H02H 9/04; H02H 9/041; H02H 9/042; H02H 9/046; H02H 3/20

USPC ..... 218/1, 12, 102; 361/56, 103, 115, 14

See application file for complete search history.

(56) References Cited

U.S. PATENT DOCUMENTS

| | | | | |
|---|---|---|---|---|
| 4,677,518 | A * | 6/1987 | Hershfield | 361/56 |
| 5,124,873 | A * | 6/1992 | Wheeler et al. | 361/58 |
| 5,909,351 | A * | 6/1999 | Kane | 361/120 |
| 6,765,777 | B2 * | 7/2004 | Cantagrel | 361/103 |

FOREIGN PATENT DOCUMENTS

| | | | |
|---|---|---|---|
| SI | SI23043 | * 10/2010 | H02H 3/20 |

OTHER PUBLICATIONS

Machine translation(abstract) of SI23043 (orig. doc. published Oct. 29, 2010).*

* cited by examiner

*Primary Examiner* — Renee Luebke
*Assistant Examiner* — William Bolton
(74) *Attorney, Agent, or Firm* — The Watson I.P. Group, PLC; Jovan N. Jovanovic; Vladan M. Vasiljevic

(57) ABSTRACT

The invention belongs to the field of overvoltage protection devices intended to protect sensitive electric/electronic devices and assemblies against effects of increased voltages, more precisely to the field of overvoltage protective devices provided with an electronic assembly intended to extend a life span of the basic component and to ensure a higher quality level of protection of electronic devices. The redundant overvoltage circuit breaker with a rotational disk and with an added electronic assembly intended to extend a life span of an overvoltage component is characterized in that it has a gas discharge tube (3) connected in series with a coil (5) and a resistor (4) with a positive thermal characteristic, and a gas discharge tube (6) connected parallel thereto; that a common point of these two branches prevents a route of leakage current via gas discharge tube (3) between the terminals, which can be connected to a line or neutral conductor, via varistor to an earthing point; that there is no leakage current in any of these two branches, since the varistor is galvanically separated between the clamp terminal and the earthing point; that in case of increased current surges the gas discharge tube (6) discharges through a branch of the varistor (7 and 8) into the earthing point; that the varistors (7 and 8) each has its own rotational circuit breaker (9 and 10).

4 Claims, 2 Drawing Sheets

Figure 1:
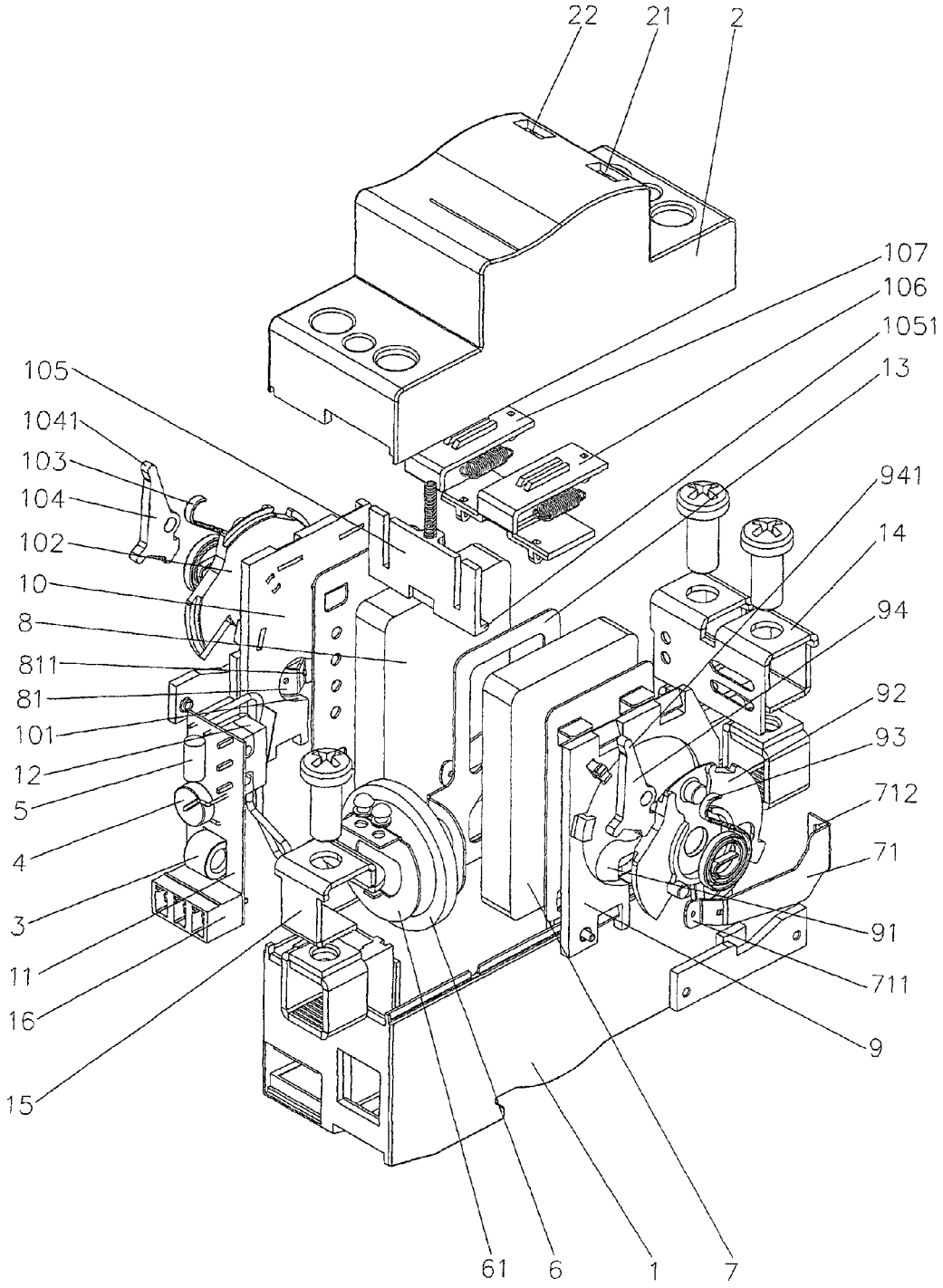

REDUNDANT EXCESS VOLTAGE CIRCUIT BREAKER WITH A ROTATIONAL DISK AND WITH AN ADDED ELECTRONIC ASSEMBLY INTENDED TO EXTEND A LIFE SPAN OF AN EXCESS-VOLTAGE COMPONENT

FIELD OF INVENTION

The invention belongs to the field of overvoltage protection devices intended to protect sensitive electric/electronic devices and assemblies against effects of increased voltages, more precisely to the field of overvoltage protective devices provided with an electronic assembly intended to extend a life span of the basic component and to ensure a higher quality level of protection of electronic devices.

TECHNICAL PROBLEM

The technical problem solved by the present invention is a construction of electronic and mechanical shutoff of an overvoltage component that will rapidly and reliably limit transient voltage increases in mains when an electric arc occurs and the component gets consequently thermally loaded or overloaded. The task and goal of the invention is a further electronic assembly intended to ensure a longer life span of an overvoltage component, which means that low leakage current of a component, preferably a varistor, needs to be prevented from getting into an earthing point. The protection system should be redundant: there should be at least double protection by means of an efficient triggering of remote signalisation that will mechanically show which part of the overvoltage component has failed. The solution must ensure both a quick response to an instantaneous voltage occurrence, when, in the worst case scenario, thermal overload of a component could lead to a fire, and a safe operation of the overvoltage arrester or the mechanical disconnection in connection with an electronic assembly.

PRIOR ART

Overvoltage arresters are electric devices intended to limit overvoltages in electric-energetic systems; they can use AC or DC, and systems combining both voltage types are more and more often used. Overvoltages differ in the length of their duration and can be divided in two groups: transient, caused due to switching manipulations and overvoltages caused due to atmospheric discharges; and the so-called temporary overvoltages that appear due to errors in mains, such as short circuits, contact with a high-voltage system, unstable mains and similar anomalies in electricity supply.

Known components of overvoltage arresters are for instance dischargers, varistors, and diodes, to mention just the most widely used ones. They all have a common characteristic: at a certain increased voltage they switch to a state of conductivity and discharge the increased voltage in direction towards the earth via protective conductor.

Most common problems appear when long-lasting increased voltage, which can be present for several hours or even days, leads to destruction of an overvoltage arrester and even to a fire in the worst case scenario. Several ways of solving these situations/problems are known and all share a common characteristic: they exploit a transition of the above-mentioned components into their conductive state. After its transition into a conductive state, the overvoltage arrester is disconnected from the mains by overcurrent protection or by a differential current switch or even a device adapted for this purpose that detects an increased current/reduced resistance in direction towards a protective conductor. These additional solutions can be external, fitted to an overvoltage arrester, or internal, where further protective elements are built into a unique casing. However, several problems are encountered with these additional solutions, for instance overvoltage arresters do not preserve the same property as they had before upgraded with new solutions.

There are several solutions on the market that solve the problem of an electric arc and of electrical thermal overloads in varistors. A known solution is disclosed in U.S. Pat. No. 6,430,019 and patent No. SI23043, where danger of an electric arc in case of a critical heating of a varistor is prevented by a barrier that separates the overheated body of the varistor from a connecting electrode by a translational movement into the gap between the disconnected electrode and the varistor body, thus preventing an electric arc.

A solution from DE 10 2007 051854 discloses a shutoff based on at least one overvoltage arrester, such as a varistor, and a separation device for separating the surge arrester from the electric mains. A drawback of the mentioned solution is its lack of a reliable shutoff in all modes of varistor overvoltage at increased voltage on the varistor. Should the varistor pass to a short-circuit state before the thermal shutoff is operable, the overcurrent protection in the series will likely function in a limited way or inefficiently.

Patent application DE 10 2008 013 448 discloses a surge arrester connected in series with the device, which it protects and switches off when a predetermined distance for separation is reached in the surge arrester.

Said known solutions do not solve problems relating to the occurrence of an electric arc in overvoltage protective devices including varistors in an optimal way. There still remains the problem of leaking currents, through which an electric-thermal overload of varistors appears and in case of insufficient shutoff also an electric arc may occur, which can culminate in devastating values.

SOLUTION TO THE TECHNICAL PROBLEM

The essence of an overvoltage circuit breaker with a rotational disk and with an added electronic assembly intended to extend a life span of an overvoltage component lies in that the system is redundant and disposes over two units in the same circuit; if one fails, the other one is still operable. In such a situation a remote signalisation is triggered and mechanically shows which half of the overvoltage component has failed. The life span of the overvoltage component is increased by an additional gas discharge element in series with a coil and a resistor having a positive thermal characteristic, which prevents a route of a small leakage current of the varistor into an earthing point.

The redundant overvoltage circuit breaker of the varistor is electronically triggered by gas discharge tube and/or resistor with positive thermal characteristic immediately after an increase in electric voltage has been detected and resulted in melting of the solder of the disconnecting electrode at one of the varistor. The rotational disk is designed to extend this distance up to distances prescribed by standards. A micro switch triggers a shift of a snap plate of the indicator, thus releasing the indicator which shifts towards an opening on the casing and clearly indicates that the varistor is disconnected from active parts of the mains and that only the second rotational circuit breaker of the varistor is operable.

The redundant overvoltage circuit breaker with a rotational disk and with an added electronic assembly intended to extend a life span of an overvoltage component of the invention will now be described in more detail with reference to the enclosed drawings, which show:

FIG. 1—assembly of a redundant overvoltage circuit breaker of the invention

Figure 2:
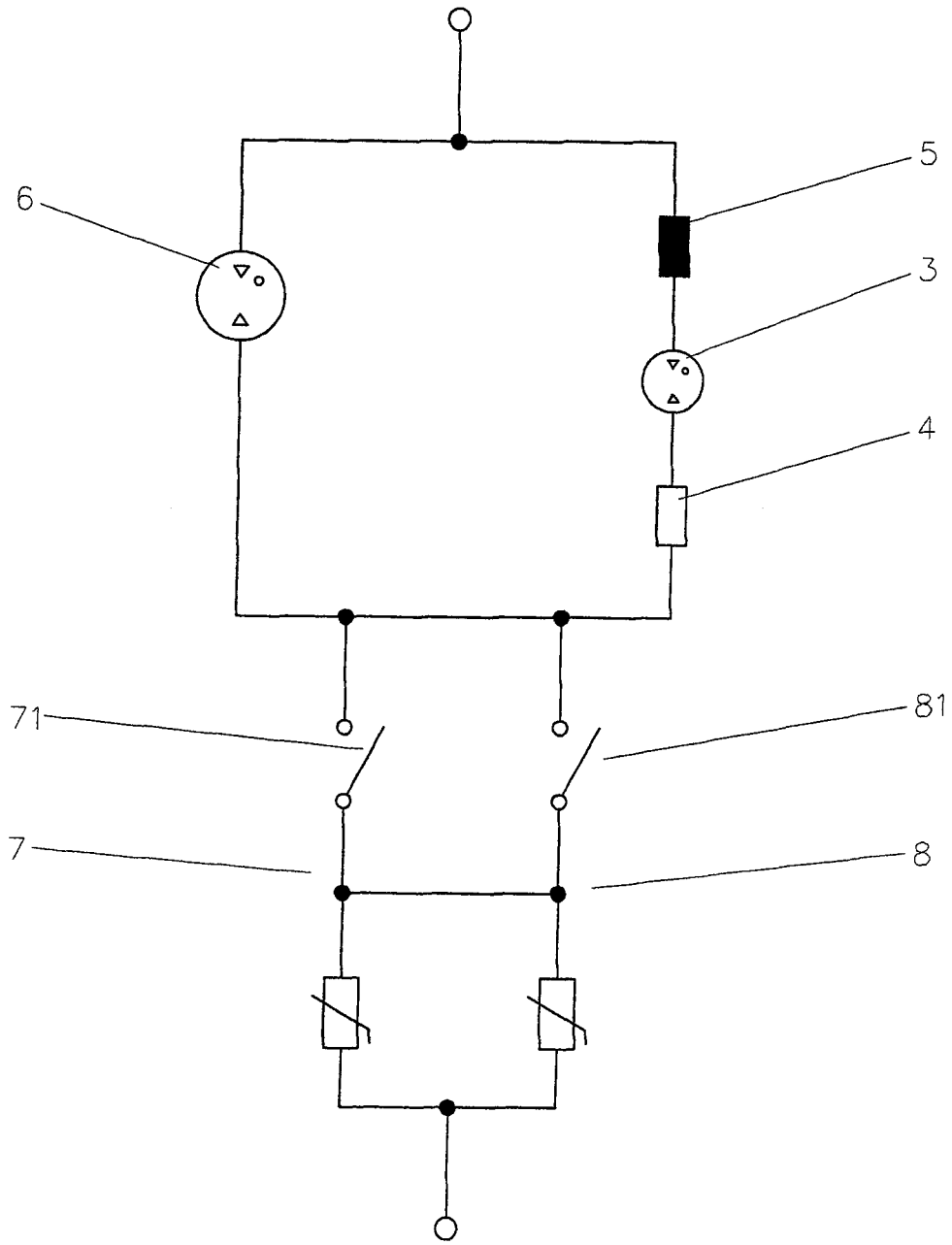

FIG. 2—scheme of the electronic circuit breaker of the invention

The redundant overvoltage circuit breaker of the invention has a gas discharge tube 3 connected in series with a coil 5 and a resistor 4 with a positive thermal characteristic, and a gas discharge tube 6 connected parallel thereto. A common point of these two branches prevents a route of leakage current via gas discharge tube 3 of one of terminals, which can be connected to a line or neutral conductor, via varistor to an earthing point, which means that it does not cause the varistor to age due to a phenomenon of the leakage current of the varistor. The result of this connection is that there is no leakage current in any of these two branches, since the varistor is galvanically separated between the clamp terminal and the earthing point. Another advantage of such configuration of the circuit lies in that in case of increased current surges the gas discharge tube 6 discharges through a branch of the varistor 7 and 8 into the earthing point. In case of an increased voltage between the terminal of the overvoltage arrester and the earthing point, the second current route gets activated, said current route consisting of a coil 5, a gas discharge tube 3 and a resistor 4. This branch is intended to prevent thermal runaway of the varistor in case of an overvoltage load—when the voltage between the terminals exceeds the declared value of the overvoltage arrester. The thermal circuit breaker of the varistor is an additional fuse in case of an extreme overload, since the thermal clamp terminal gets disconnected in case of an increased transient current above the declared (dimensioned $I_{max}$ ali $I_{imp}$) value. The varistors 7 and 8 each has a rotational circuit breaker 9 and 10.

The redundant overvoltage circuit breaker comprises a casing 1 incorporating the first rotational circuit breaker 9 of the varistor 7, the second rotational circuit breaker 10 of the varistor 8, the overvoltage gas discharge tube 3, the coil 5, the resistor 4 on a printed circuit board 11 and micro switches 12 on the other side of the board 11. Between the varistor 7 and the varistor 8 there is an electrode 13 intended as a carrier of the gas discharge tube 6. The casing 1 is covered with a cover 2 corresponding in its shape to the shape of the bottom of the casing 1 and the shape of the built-in elements. A contact of a bent part 711 of the thermal circuit breaker is provided through an opening 91 of the first rotational circuit breaker 9 onto the body of the varistor 7, said circuit breaker being simultaneously also a connecting electrode 71. The contact of the varistor 7 and the bent part 711 is carried out by means of a temperature sensitive soldering flux. In this position, the electrode 71 holds the rotational disk 92 in the initial position together with a helical spring 93 in a tensioned state. A top 941 of the snap plate 94 is inserted in a way to be stuck behind an edge 1051 of an indicator 105 of signalisation of the initial state. Another end 712 of the connecting electrode 71 is fastened to a clamp terminal 14. A second clamp terminal 15 is connected with the electrode 61 of the gas discharge tube 6.

Through an opening 101 of the second rotational circuit breaker 10, a contact of the bent part 811 of the thermal circuit breaker—which, is simultaneously also a connecting electrode 81—is applied. The contact of the varistor 8 and the bent part 811 is carried out with a temperature sensitive soldering flux. In this position, the electrode 81 holds the rotational disk 102 in its initial position together with the helical spring 103 in the tensioned state. The top 1041 of the snap plate 104 is inserted into a bearing of the indicator of initial state signalisation. Another end of the connecting electrode 81 is fastened to the clamp terminal 14. The second clamp terminal 15 is connected with the electrode 61 of the gas discharge tube 6.

When the heating of the body of the varistor 7 reaches the critical level due to current surges and increased current running through the body of the varistor 7, the temperature sensitive soldering flux, which binds together the disconnecting electrode 711 and the body of the varistor 7, gets melted. As a result, the disconnecting electrode 71 is released and shifts through the opening 91 of the rotational circuit breaker 9 into a not tensioned position and consequently releases the rotational disk 92 which was in the initial position up to this moment. Under the influence of the spring force of the helical spring 93, the rotational disk 92 moves with high angular velocity from one end position to another end position and covers the opening 91 in the carrier of the rotational circuit breaker 9, thus preventing the occurrence of an electric arc. The movement of the rotational disk 92 triggers the snap plate 94 which releases with its lug 941 an indicator 105 that moves from a vertical position into a horizontal position, wherein it pushes with its lug 1051 an indication plate 106. When the red coloured indication plate 106 shifts, an indication of breakdown of the overvoltage arrester appears on a transparent window 21 of the cover 2. A shift of the indicator 105 releases the micro switch 12 which sends a signal on the state of the overvoltage arrester to the control system of the installation via the clamp terminal 16.

When the heating of the body of the varistor 8 reaches the critical level due to current surges and increased current running through the body of the varistor 8, the temperature sensitive soldering flux, which binds together the disconnecting electrode 811 and the body of the varistor 8, gets melted. As a result, the disconnecting electrode 81 is released and shifts through the opening 101 of the rotational circuit breaker 10 into a not tensioned position and consequently releases the rotational disk 102 which was in the initial position up to this moment. Under the influence of the spring force of the helical spring 103, the rotational disk 102 moves with high angular velocity from one end position to another end position and covers the opening 101 in the carrier of the rotational circuit breaker 10, thus preventing the occurrence of an electric arc. The movement of the rotational disk 102 triggers the snap plate 104 which releases with its lug 1041 an indicator 105 that moves from a vertical position into a horizontal position, wherein it pushes with its lug 1041 an indication plate 107. When the red coloured indication plate 107 shifts, an indication of breakdown of the overvoltage arrester appears on a transparent window 22 of the cover 2. A shift of the indicator 105 releases the micro switch 12 which sends a signal on the state of the overvoltage arrester to the control system of the installation via the clamp terminal 16.

The overvoltage circuit breaker of the invention is a redundant system comprising the above described two independent rotational circuit breakers in the same circuit, and when one fails, the other one is operable and enables a further protection of consumer loads against overvoltages. When one or the other rotational circuit breaker is disconnected, remote signalisation is triggered, which mechanically shows which overvoltage circuit breaker has failed. The life span of the overvoltage arrester is extended by a further gas discharge tube 3 in series with the coil 5 and the resistor 4 with positive thermal characteristic with the parallel bound gas discharge tube 6, in this way the small leakage current is prevented to escape through the varistors 7 and 8 to the earthing point.

An advantage of the redundant overvoltage circuit breaker of the invention lies in that it triggers a shutoff only in case when a more considerable current surge appears, which causes a shutoff of the thermal clamp of one of the varistors 7 or 8 in a combination with the rotational assembly 9 or 10. Under the influence of the spring force of the helical spring, the rotational disk 9 or 10—after the electrode 71 or 81 was disconnected—moves with high angular velocity from one end position to another end position and covers the opening in the carrier of the rotational disk, thus preventing the occurrence of an electric arc.

The redundant overvoltage circuit breaker according to embodiment I may have three or more rotational circuit breakers connected in parallel between the output common point of the parallel circuit of the gas discharge tube 6 with the series connected coil 5, the gas discharge tube 3 and the resistor 4.

A threshold of overload above the declared value is precisely set by dimensioning the volume of the varistor, metallic varistor connecting electrodes, and the selection of the point of melting of the soldering flux of the thermal circuit breaker. A selection of material for the body of the varistor and the varistor electrodes additionally contributes to a precise setting of the threshold of safe shutoff of the varistor.

The invention claimed is:

1. A redundant overvoltage circuit breaker with a rotational disk and with an added electronic assembly for extending a life span of an overvoltage component, characterised in that it has a gas discharge tube (3) connected in series with a coil (5) and a resistor (4) with a positive thermal characteristic, and a gas discharge tube (6) connected parallel to the gas discharge tube (3), the coil (5) and the resistor (4); that a common point of these two branches prevents a route of leakage current via gas discharge tube (3) of one of terminals, which can be connected to a line or neutral conductor, via a varistor to an earthing point; that there is no leakage current in any of these two branches, since the varistor is galvanically separated between the clamp terminal and the earthing point; that in case of increased current surges the gas discharge tube (6) discharges through a branch of the varistor (7 and 8) into the earthing point; that the varistors (7 and 8) each has its own rotational circuit breaker (9 and 10).

2. Redundant overvoltage circuit breaker with a rotational disk and with an added electronic assembly for extending a life span of an overvoltage component according to claim 1, characterised in that it comprises a casing (1) incorporating a first rotational circuit breaker (9) of the varistor (7), a second rotational circuit breaker (10) of the varistor (8), that it has the overvoltage gas discharge tube (3), the coil (5), and the resistor (4) on a printed circuit board (11) and a micro switch (12) on the other side of the board (11); that between the varistor (7) and the varistor (8) there is an electrode (13) which is configured as a carrier of the gas discharge tube (6); that the casing (1) is covered with a cover (2) corresponding in its shape to the shape of the bottom of the casing (1) and the shape of the built-in elements; that a contact of a bent part (711) of a thermal circuit breaker is provided through an opening (91) of the first rotational circuit breaker (9) onto a body of the varistor (7), said circuit breaker being simultaneously also a connecting electrode (71); that the contact of the varistor (7) and the bent part (711) is carried out by means of a temperature sensitive soldering flux; that in this position, the electrode (71) holds the rotational disk (92) in the initial position together with a helical spring (93) in a tensioned state; that a top (941) of a snap plate (94) is inserted in a way to be stuck behind an edge (1051) of an indicator (105) of signalisation of the initial state; that another end (712) of the connecting electrode (71) is fastened to a clamp terminal (14); that a second clamp terminal (15) is connected with an electrode (61) of the gas discharge tube (6); that through an opening (101) of the second rotational circuit breaker (10) onto the body of the varistor (8) a contact of the bent part (811) of the thermal circuit breaker—which is simultaneously also a connecting electrode (81)—is carried out; that the contact of the varistor (8) and the bent part (811) is carried out with a temperature sensitive soldering flux; that in this position, the electrode (81) holds the rotational disk (102) in its initial position together with the helical spring (103) in the tensioned state; that the top (1041) of the snap plate (104) is inserted into a bearing of the indicator of initial state signalisation; that another end of the connecting electrode (81) is fastened to the clamp terminal (14); that the second clamp terminal (15) is connected with the electrode (61) of the gas discharge tube (6); that when the heating of the body of the varistor (7) reaches the critical level due to current surges and increased current running through the body of the varistor (7), the temperature sensitive soldering flux, which binds together the disconnecting electrode (711) and the body of the varistor (7), gets melted; that as a result, the disconnecting electrode (71) is released and shifts through the opening (91) of the rotational circuit breaker (9) into a not tensioned position and consequently releases the rotational disk (92) which was in the initial position up to this moment; that under the influence of the spring force of the helical spring (93), the rotational disk (92) moves with high angular velocity from one end position to another end position and covers the opening (91) in the carrier of the rotational circuit breaker (9), thus preventing the occurrence of an electric arc; that the movement of the rotational disk (92) triggers the snap plate (94) which releases with its lug (941) an indicator (105) that moves from a vertical position into a horizontal position, wherein it pushes with its lug (1051) an indication plate (106); that when the red coloured indication plate (106) shifts, an indication of breakdown of the overvoltage arrester appears on a transparent window (21) of the cover (2); that a shift of the indicator (105) releases the micro switch (12) which sends a signal on the state of the overvoltage arrester to the control system of the installation via the clamp terminal (16); that when the heating of the body of the varistor (8) reaches the critical level due to current surges and increased current running through the body of the varistor (8), the temperature sensitive soldering flux, which binds together the disconnecting electrode (811) and the body of the varistor (8), gets melted; that as a result, the disconnecting electrode (81) is released and shifts through the opening (101) of the rotational circuit breaker (10) into a not tensioned position and consequently releases the rotational disk (102) which was in the initial position up to this moment; that under the influence of the spring force of the helical spring (103), the rotational disk (102) moves with high angular velocity from one end position to another end position and covers the opening (101) in the carrier of the rotational circuit breaker (10), thus preventing the occurrence of an electric arc; that the movement of the rotational disk (102) triggers the snap plate (104) which releases with its lug (1041) an indicator (105) that moves from a vertical position into a horizontal position, wherein it pushes with its lug (1041) an indication plate (107); that when the red coloured indication plate (107) shifts, an indication of breakdown of the overvoltage arrester appears on a transparent window (22) of the cover (2); that a shift of the indicator (105) releases the micro switch (12) which sends a signal on the state of the overvoltage arrester to the control system of the installation via the clamp terminal (16).

3. Redundant overvoltage circuit breaker with a rotational disk and with an added electronic assembly for extending a life span of an overvoltage component according to claim 1, characterised in that it has three or more rotational circuit breakers connected in parallel between the output common point of the parallel circuit of the gas discharge tube (6) with the series connected coil 5, the gas discharge tube (3) and the resistor (4).

4. Redundant overvoltage circuit breaker with a rotational disk and with an added electronic assembly for extending a life span of an overvoltage component according to claim 1, characterised in that a threshold of overload above the declared value is precisely set by dimensioning the volume of the varistor, metallic varistor connecting electrodes, and the selection of the point of melting of the soldering flux of the thermal circuit breaker; that a selection of material for the body of the varistor and the varistor electrodes additionally contributes to a precise setting of the threshold of safe shutoff of the varistor.

* * * * *